US005836615A

United States Patent [19]

Elliot et al.

[11] Patent Number: 5,836,615

[45] Date of Patent: Nov. 17, 1998

[54] BOOK CONSTRUCTION WITH RELEASABLE ADHESIVE

[76] Inventors: Michael Elliot, deceased, late of New York, N.Y.; by Michaele Elliot, executor, 60 E. 96th St., New York, N.Y. 10128; by Peter Elliot, executor, 866 River Rd., Piermont, N.Y. 10968

[21] Appl. No.: 435,402

[22] Filed: May 10, 1995

[51] Int. Cl.[6] ..... B42D 1/00

[52] U.S. Cl. ..... 281/21.1; 281/45; 281/36; 283/57

[58] Field of Search ..... 281/36, 37, 45, 281/21.1, 15.1; 283/57

[56] References Cited

U.S. PATENT DOCUMENTS

| | | | |
|---|---|---|---|
| Re. 24,906 | 12/1960 | Ulrich . | |
| 3,437,506 | 4/1969 | Falberg . | |
| 3,794,550 | 2/1974 | Taillie | 281/2 |
| 3,956,053 | 5/1976 | Staats . | |
| 3,995,886 | 12/1976 | Staats . | |
| 4,244,069 | 1/1981 | Hale . | |
| 4,266,812 | 5/1981 | Staats . | |
| 4,345,349 | 8/1982 | Flanagan . | |
| 4,385,225 | 5/1983 | Giulie . | |
| 4,471,976 | 9/1984 | Giulie . | |
| 4,562,102 | 12/1985 | Rabuse et al. . | |
| 4,588,028 | 5/1986 | Marshall et al. | 165/185 |
| 4,701,828 | 10/1987 | Weiner | 361/383 |
| 4,708,560 | 11/1987 | Abildgaard . | |
| 4,884,331 | 12/1989 | Hinshaw | 29/558 |
| 5,052,872 | 10/1991 | Hunder et al. | 281/36 X |
| 5,308,208 | 5/1994 | Ranson . | |
| 5,350,268 | 9/1994 | Muller . | |
| 5,407,230 | 4/1995 | Brink et al. | 281/29 |
| 5,425,554 | 6/1995 | Lamanna | 281/21.1 |
| 5,452,920 | 9/1995 | Parker | 281/36 X |
| 5,641,550 | 6/1997 | Berman et al. | 281/2 |

*Primary Examiner*—Willmon Fridie, Jr.
*Attorney, Agent, or Firm*—Lucas & Just

[57] ABSTRACT

A book with releasable and resecurable pages is disclosed. The pages are between two covers and secured along their edges to a binding by an inherently tacky adhesive.

4 Claims, 2 Drawing Sheets

BOOK CONSTRUCTION WITH RELEASABLE ADHESIVE

The present invention relates to a book construction for paper, and, in particular, to a book construction having opposed covers and a binding and wherein the paper is releasably secured against the binding. This is achieved by using an adhesive on the binding which is inherently tacky, i.e. one from which paper may be removed and subsequently resecured a plurality of times.

Book constructions for paper are well-known in the art. They typically comprise a front cover, a back cover, and a binding, with the paper being secured between the front and back covers by the binding. The binding can be mechanical, such as a spiral, or it can be an adhesive such as those typically used in both hard-cover and soft-cover books. In every known case, the binding is intended to "permanently" bind the pages of paper so that they do not become dislodged from the binding during use. Indeed, if a page does come loose from a binding, as seems to happen all too often with some paperback books, the loose page soon becomes dog-eared and frequently becomes lost.

There are, of course, situations where it is desired that one or more pages be readily removable from the binding. Typical of these instances are writing pads, such as stationery pads, legal pads, note pads, etc.

With these pads, the paper is sometimes perforated adjacent the binding; in other cases, the adhesive is designed to release the paper if it is lifted off in a way that creates high shear. In either case, however, once the page has been removed there is no way to resecure the page in the pad. Furthermore, because of the nature of the adhesive, some of the adhesive is likely to adhere to the piece of paper that is removed and, as discussed hereinafter, interfere with the use of the removed paper.

The applicants have now discovered a book construction which permits easy removal of any page desired to be removed.

FIG. 2 shows the open book of FIG. 1 with only a single sheet of paper; and FIG. 3 shows one construction for the covers and binding.

Furthermore, if desired, the page can be reinserted and again be securely held in place by the adhesive on the binding. In a preferred embodiment, the page removed carries with it substantially no adhesive, and more preferably, no adhesive whatsoever is carried with the removed page. In this way, the adhesive does not interfere with subsequent use of the paper, e.g. in a vending machine, automatic sorting machine, etc.

Applicants consider the present invention to be especially useful for the binding of paper currency, notably that which has been freshly minted. Freshly minted currency is typically in pristine condition, i.e. it is flat, unwrinkled, not soiled, and has smooth, straight edges. Such currency can readily be used in the book construction of the present invention, and the book construction of the present invention makes a very nice presentation piece for fresh paper currency. Such currency can be sold as a novelty item, e.g. at the Bureau of Engraving or banks, or it can be sold as a convenience item, such as for birthday, holiday and special occasion gifts, for use by hospital patients and the like. Since currency removed from a book construction made in accordance with a preferred embodiment of the invention will have little or no adhesive on the edges thereof, currency removed can be readily used in vending machines. The currency can be of a single denomination, e.g. 50 or 100 one dollar bills, or it can be multiple denominations, e.g. 40 one dollar bills, 4 five dollar bills and 4 ten dollar bills. In the latter case it is preferred that the bills be separated in ascending order so that there is no confusion in removing the appropriate bill. It will be understood that the binder of the present invention can be used not only for U.S. currency, but also for currency of any country.

In addition to use for currency, the present invention can be used for a wide number of other applications where it is desired either to have a piece of paper readily removable and readily resecured, or have a secured piece of paper removed with little or no adhesive thereon. The present invention is very useful, for example, for bank checks; similarly, the present invention can be used with stock or bond certificates, store coupons, gift certificates, transportation tickets/vouchers, etc. The highly beneficial nature of the present invention is that one or more pieces of paper can be removed from a book construction, can be resecured if desired and, in any case, can be substantially adhesive-free when removed. The latter feature is especially desirable where the piece of paper will subsequently be inserted into automatic processing machinery such as a vending machine, a check processing machine, a transportation fare box, or the like.

These and other aspects of the present invention may be more fully understood with reference to the drawings wherein.

Figure 1:
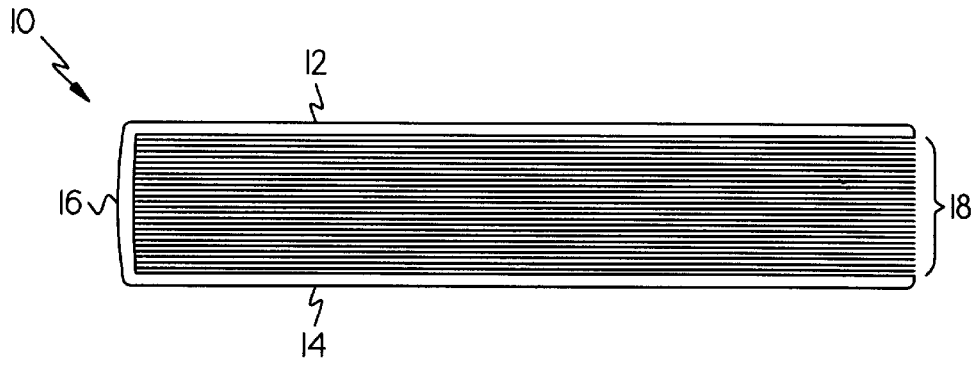
FIG. 1 shows one embodiment of the present invention.

Referring first to FIG. 1 there is shown a book 10 comprising a top cover 12, a bottom cover 14, and backing 16. A series of sheets of paper 18 are adhered to the backing 16.

Figure 2:
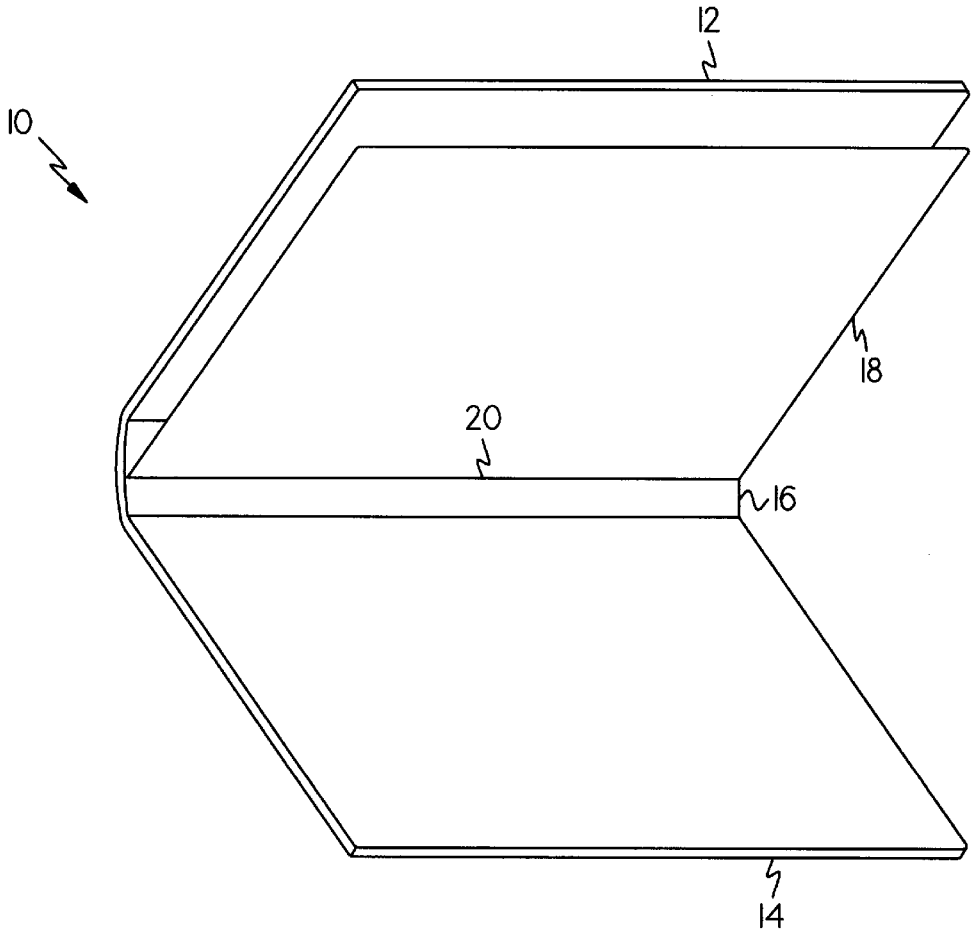
FIG. 2 shows the open book of FIG. 1 with only a single sheet of paper.

In FIG. 2 there is shown the book 10 of FIG. 1 with top cover 12, bottom cover 14, backing 16 and a single sheet of paper 18 adhered to the backing 16. As can be seen, the single sheet of paper 18 is adhered to the backing 16 along edge 20 of sheet of paper 18. The sheets of paper 18 in FIG. 1 are similarly adhered to the backing 16 of the book 10 of FIG. 1

Backing 16 has an inherently tacky adhesive on the surface thereof which engages the edge 20 of sheet of paper 18. The inherently tacky adhesives are disclosed in U.S. Pat. No. 3,691,140 issued Sep. 12, 1972, the teaching of the same being incorporated herein by reference. The inherently tacky adhesives as taught in the '140 patent are copolymers of an alkyl acrylate ester with an ionic monomer or maleic anhydride. Typical of the ionic monomers are sodium methacrylate, trimethylamine P-vinyl benzimide and other ionomers as set forth in the '140 patent. It is not, of course, necessary to use the adhesives of the '140 patent. Any adhesive which is reusable can be employed, i.e. any adhesive from which a sheet of paper 18 can be removed and then reattached.

It is preferred that the inherently tacky adhesive be maintained in place such as taught in U.S. Pat. No. 3,857,731, issued Dec. 31, 1974, and the relevant teaching of which is incorporated herein by reference. The '731 patent teaches a substrate with a binder material thereon, and partially embedded in the surface of the binder and protruding therefrom are inherently tacky copolymer microspheres made in accordance with U.S. Pat. No. 3,691,140, discussed above.

Figure 3:
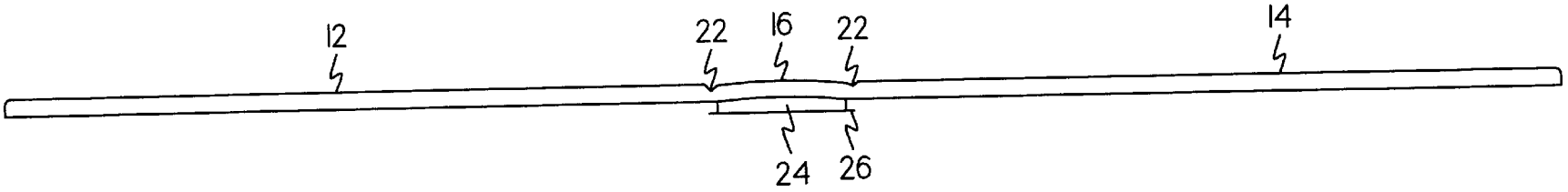
FIG. 3 shows one construction for the covers and binding.

As shown in FIG. 3, the covers 12 and 14 and the backing 16 can be made of a single piece, suitably with notches 22 to permit folding of the covers. Adhesive 24 as previously described is applied to the backing 16.

The adhesive may be applied directly to the backing, or it may be applied in the form of a double-faced tape. With a double-faced tape, the side which is against the backing 16 will preferably have greater adhesive strength than the side which faces the edges 20 of the pieces of paper 18 so that the tape remains adhered to the backing 16 even if a plurality of pieces of paper 18 or all of the pieces of paper 18 are simultaneously removed.

While it is preferred that the book 10 be sold as a complete unit, it will be appreciated that the book 10 can be sold empty for subsequent insertion of whatever paper is desired. In such case, it is preferred that the empty books be sold in the form shown in FIG. 3. A protective film 26 can be applied over the adhesive 24 to protect the adhesive during transport. The protective film is suitably a polymer-coated paper which can be readily removed without removing any substantial amount of the adhesive.

In the preferred embodiment of the present invention, the book of the present invention is used to secure United States currency, notably freshly minted one dollar bills. The front and back cover are made from one continuous piece of material with the front and back covers being substantially the size of the dollar bill and the backing being of sufficient width to contain a stack of 100 one dollar bills. The continuous piece of material is suitably of the weight and texture commonly used for manila file folders. The backing has affixed to it a double-faced tape, specifically No. 9425 available from 3M Company, Minneapolis, Minn. The surface of the tape which faces the interior of the book has an inherently tacky adhesive at the surface thereof. The top edges of the dollar bills are butted against the double-faced tape and are retained in the book due to the adhesive force of the inherently tacky adhesive. Any one or more of the bills can be readily removed from the book, and can be reinserted if desired. If reinserted, the inherently tacky adhesive on the No. 9425 double-faced tape will resecure the dollar bill in the book. Dollar bills which are removed are found to have substantially no or no adhesive along the top edge which has engaged the inherently tacky adhesive of the 3M No. 9425 double-faced tape.

It will be understood that the claims are intended to cover all changes and modifications of the preferred embodiments of the invention herein chosen for the purpose of illustration which do not constitute a departure from the spirit and scope of the invention.

What is claimed is:

1. A book containing currency comprising a front cover and a back cover each of which is attached to a backing, said backing having a binder and having an inherently tacky adhesive which is embedded in said binder and protrudes therefrom, said tacky adhesive comprising a copolymer of an alkyl acrylate ester and an ionic monomer or maleic anhydride, and a plurality of sheets of currency releasably secured to said inherently tacky adhesive of said backing between said front cover and said back cover, said plurality of sheets of currency being secured to said backing along one edge of each said sheet of currency, each said sheet of currency being removable from and resecurable to the said adhesive on said backing so as to allow said sheet of currency to be removed and subsequently resecured a plurality of times.

2. The book construction of claim 1 wherein the front cover, back cover and backing constitute a single piece.

3. The book construction of claim 1 wherein the currency is U.S. currency.

4. The book construction of claim 3 wherein the U.S. currency is one dollar bills/or any denomination of bills.

* * * * *

UNITED STATES PATENT AND TRADEMARK OFFICE

CERTIFICATE OF CORRECTION

PATENT NO. : 5,836,615

DATED : November 17, 1998

INVENTOR(S) : Michael Elliot et al.

It is certified that error appears in the above-indentified patent and that said Letters Patent is hereby corrected as shown below:

On the face of the patent, the identification of inventors is corrected as follows:

Inventors: Michael Elliot, deceased, late of New York, N.Y.; by Michaele Elliot, executor, 60 E. 96th St., New York, N.Y. 10128; by Peter Elliot, executor, 866 River Rd., Piermont, N.Y. 10968; Michaele Elliot, New York, N.Y.

Signed and Sealed this

Twenty-first Day of September, 1999

*Attest:*

Q. TODD DICKINSON

*Attesting Officer*

*Acting Commissioner of Patents and Trademarks*